US012765660B2

(12) United States Patent
Mercury

(10) Patent No.: US 12,765,660 B2
(45) Date of Patent: Oct. 20, 2026

(54) HEAD SUPPORT

(71) Applicant: Lejean Mercury, Ontario, OR (US)

(72) Inventor: Lejean Mercury, Ontario, OR (US)

( * ) Notice: Subject to any disclaimer, the term of this patent is extended or adjusted under 35 U.S.C. 154(b) by 0 days.

(21) Appl. No.: 19/531,474

(22) Filed: Feb. 5, 2026

(65) Prior Publication Data

US 2026/0165451 A1 Jun. 18, 2026

Related U.S. Application Data

(60) Provisional application No. 63/728,578, filed on Dec. 5, 2024.

(51) Int. Cl.
*A45D 44/10* (2006.01)
*A47G 9/10* (2006.01)

(52) U.S. Cl.
CPC ..... *A45D 44/10* (2013.01); *A47G 9/1081* (2013.01)

(58) Field of Classification Search
None
See application file for complete search history.

(56) References Cited

U.S. PATENT DOCUMENTS 7,406,732 B2 * 8/2008 Ramaiah ..... A61G 13/12 5/636

* cited by examiner

*Primary Examiner* — Adam C Ortiz
(74) *Attorney, Agent, or Firm* — Shaver Swanson; Scott D. Swanson

(57) ABSTRACT

A head support to support a user's head in a supine position. The head support includes a base support member defining a cavity configured to receive and cradle at least a portion of the back of the user's head such that the back of the head is suspended above a supporting surface. At least one lateral stabilizer extends laterally from opposing sides of the base support member to resist rotation of the head support during use. At least one bumper is positioned to limit lateral rotation of the user's head out of the supine position. In some embodiments, the base support member has a substantially toroidal shape, includes contoured inner surfaces, and is sloped from a rear portion toward a front portion. Optional features include attachable secondary supports for adjusting bumper width and a removable neck support.

16 Claims, 7 Drawing Sheets

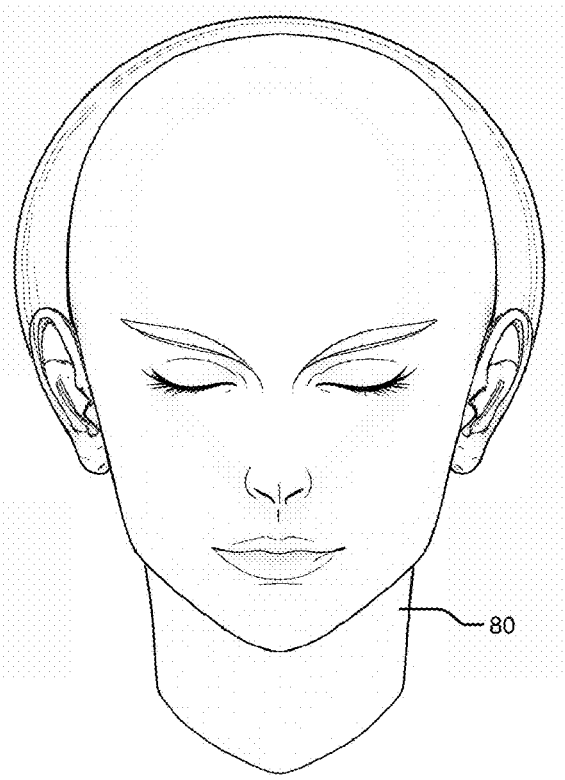
FIG. 6
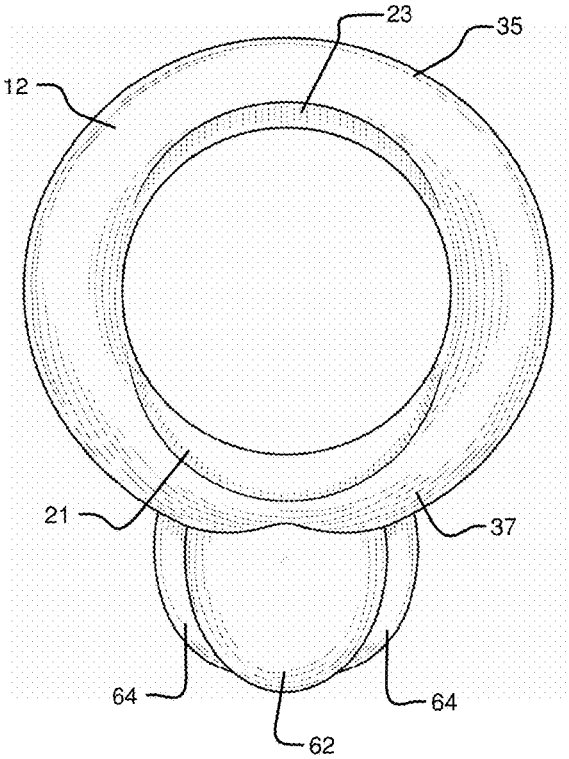
FIG. 6.1

HEAD SUPPORT

CROSS-REFERENCE TO RELATED APPLICATIONS

This application claims the benefit of U.S. Provisional Application No. 63/728,578, filed Dec. 5, 2024 the disclosure of which is incorporated by reference.

FIELD OF THE INVENTION

The presently disclosed technology relates to a head support for supporting a sleeping person's head, in particular the present invention is a head support for retaining the sleeping person's head in a supine position by discouraging the person from rolling over or rotating the head.

BACKGROUND

Skin wrinkles are a common occurrence as people age. Reducing these wrinkles from forming and treating wrinkles is a very important aspect of the beauty industry. The wrinkle treatment and/or wrinkle prevention industry is very large and diverse in the United States with many different attempts to treat and prevent wrinkles. It is believed by the applicant that an individual sleeping on their side or stomach repeatedly applies pressure against the collagen, dermis, skin tissues of the face, neck, décolleté, etc. and promotes the breakdown of the collagen, dermis, skin tissues, etc. in these areas. It is further believed by the applicant that repeatedly applying pressure to the face, neck, décolleté, etc. eventually leads to visible wrinkles, deep lines, etc. in the skin, dermis, etc. of these regions of the body. Applicant also believes currently available pillows, headpieces, etc. can sometimes press into, contact, cause pressure, friction, etc. to a person's face, neck, etc. causing damage. It is further believed by the applicant that an individual sleeping on his or her back reduces the amount of pressure applied to the individual's face, and thus reduces formation of wrinkles. While individuals may fall asleep in a supine position, their heads may rotate to the side while sleeping, resulting in pressure being applied to the side of the face, forehead, neck, etc. This is believed by the applicant to contribute to increased wrinkles, deep lines, etc. forming. What is needed is a support for a person's head to keep the person's head from rotating to the side and to help prevent a person from rolling off their back to another sleeping position and to suspend the head in such a manner as to keep contact, pressure, etc. from the neck, face, etc, thus preventing the individual from sleeping on his or her face, neck, chest, etc.

SUMMARY

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

The term supine position in relation to the head as used herein refers to the head position when the human body is in a supine position.

In one embodiment, the head support comprises a base support member defining a cavity configured to receive at least a portion of the back of a user's head and to suspend the back of the user's head above a substrate on which the head support is positioned. The cavity is configured to cradle the back of the user's head while limiting movement of the head relative to the base support member.

The head support further comprises a first lateral stabilizer and a second lateral stabilizer extending laterally from the base support member on generally opposing sides of the base support member. The first and second lateral stabilizers are configured to prevent rotation of the head support when the user's head is positioned within the cavity in a supine position.

At least one bumper extends generally vertically from at least one of the lateral stabilizers or from the base support member. The bumper is positioned relative to the cavity and is configured to prevent rotation of the user's head out of the supine position when the back of the user's head is positioned within the cavity.

In some embodiments, two bumpers are provided on opposing sides of the cavity, secondary supports may be attached to the bumpers. The base support member preferably has a substantially toroidal shape, be sloped from a rear portion toward a front portion, and include contoured inner surfaces. Optional features may further include a removable neck support.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the description of the preferred embodiments is to be regarded as illustrative in nature, and not as restrictive in nature.

BRIEF DESCRIPTION OF DRAWINGS

FIG. 6 is a top view of the embodiment of FIG. 1 shown with the stabilizing member and bumpers removed to illustrate the position of the skull in the device.

FIG. 6.1 is a top view of illustration of FIG. 6 but with the person's head removed.

DETAILED DESCRIPTION OF THE FIGURES

Figure 1:
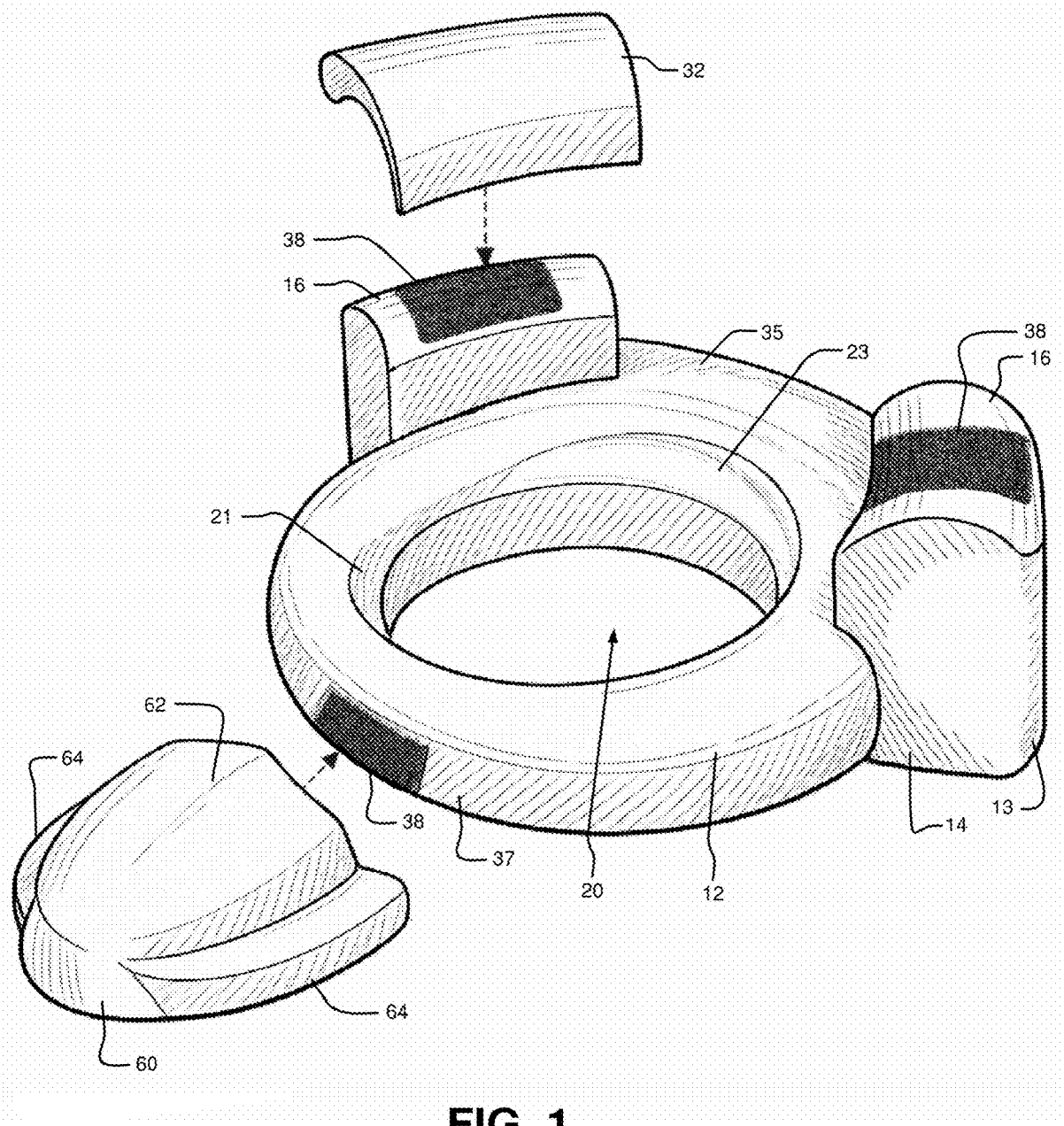
FIG. 1 is an isometric exploded elevation view of a preferred embodiment of a head support.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

FIG. 1 illustrates a preferred embodiment of a head support 10 configured for stabilizing a user in a supine position. The head support 10 includes a base support 12, stabilizing members 14 that extend to bumpers 16. The head support 10 is preferably made from or filled with a resilient, compressible pillow filling material, such as down, feathers, polyethylene tubing, or other synthetic filler material, such as polyester fiber insulating material that maintains its shape and resiliency without bunching or separating into clumps to provide firmness and uniformity to the head support.

The base support 12 is generally circular, oval, D-shaped or substantially toroidal in shape. The base support 12 defines a cavity 20 configured for receiving the rear portion of a user's head. This cavity is preferably circular as shown in FIG. 1. In the depicted embodiments the base support is generally tubular in shape. The inner perimeter of the base support is preferably contoured, such as the scooped contours 21, 23 shown at the front and back of the cavity, respectively. These contours facilitate a user inserting the back of the user's head into the cavity. The base support 12 is configured for reducing the amount of rotational and/or lateral movement of a user's head when inserted into the cavity 20, including reducing lateral rotation, flexion, and extension of the head. The base support is shown having a slope from the back 35 of the base support toward the front 37 of the base support. The bottom side of the base support is preferably flat to provide further stabilization when the base support is positioned on a surface, such as a bed or floor. The base support is constructed to be supported, but comfortable so as to be used as a pillow.

In a preferred embodiment, stabilizing support members 14 being a first lateral stabilizer and a second lateral stabilizer extend from the outside perimeter of the base support 12 to provide lateral stability to the base support 12. The stabilizing members 14 are configured to stabilize the head support 10 when a user is sleeping and prevent a user from rotating the head support 10. The stabilizing members 13 can be generally block like as shown in FIG. 1, tubular, or can be integrally formed with the base support. The depicted stabilizing members 13 have a stabilizing base 14 and extend upward to bumpers 16. The stabilizing members can be in a variety of shapes, widths, and lengths, and can be integral with the bumpers or separate from the bumpers.

Bumpers 16 extend upward from the stabilizing members 14 adjacent to the cavity 20. The bumpers 16 are configured to minimize lateral rotation of a user's head. The bumpers are configured for attaching secondary supports. This provides a layering effect to accommodate varying head sizes. The secondary supports preferably attach to the bumpers by hook and loop fasteners 38. In alternate embodiments, the secondary supports can attach via snap-fit attachment or interference fit attachment.

The stabilizing members can be formed from the same cushioning material as the base support member. Alternatively, the stabilizing members can have a firm, nonflexible construction or a core (not illustrated) within the support, such as a substantially rigid material such as metal or plastic. The core is configured to prevent flexion of the base support and stabilizing members. In this embodiment, the core is one singular piece through the stabilizing members and extends into the base support. Alternatively, the core has multiple core sections attaching together at the base support or has multiple core sections independent of one another. Alternatively, a frame can be used to prevent flexion of the stabilizing members. Alternatively, any construction that prevents flexion of the head support or portions of the head support can be used.

The embodiment of FIG. 1 includes an optional, detachable neck support 60. The neck support has a body 62 configured to ergonomically support the user's neck. In the depicted embodiment the neck support body is contoured to match the general shape of the transition between the user's head to the neck. This neck support can be connectable by hook and loop fastener, snaps, clips or other fastener. In the depicted embodiment the neck support has two protrusions 64 that provide a wider footprint of the neck support without interfering with the neck support body supporting the user's neck. FIG. 1 illustrates a secondary support 32 attached to each bumper. The secondary support extends the bumper toward the center of the ring and is used for sleepers with small heads to extend the bumper toward the head. This helps to prevent sleepers with smaller heads from rolling over. A variety of sizes of secondary supports can be utilized, and a series of secondary supports can be provided with the device, or each sold independently.

Figure 2:
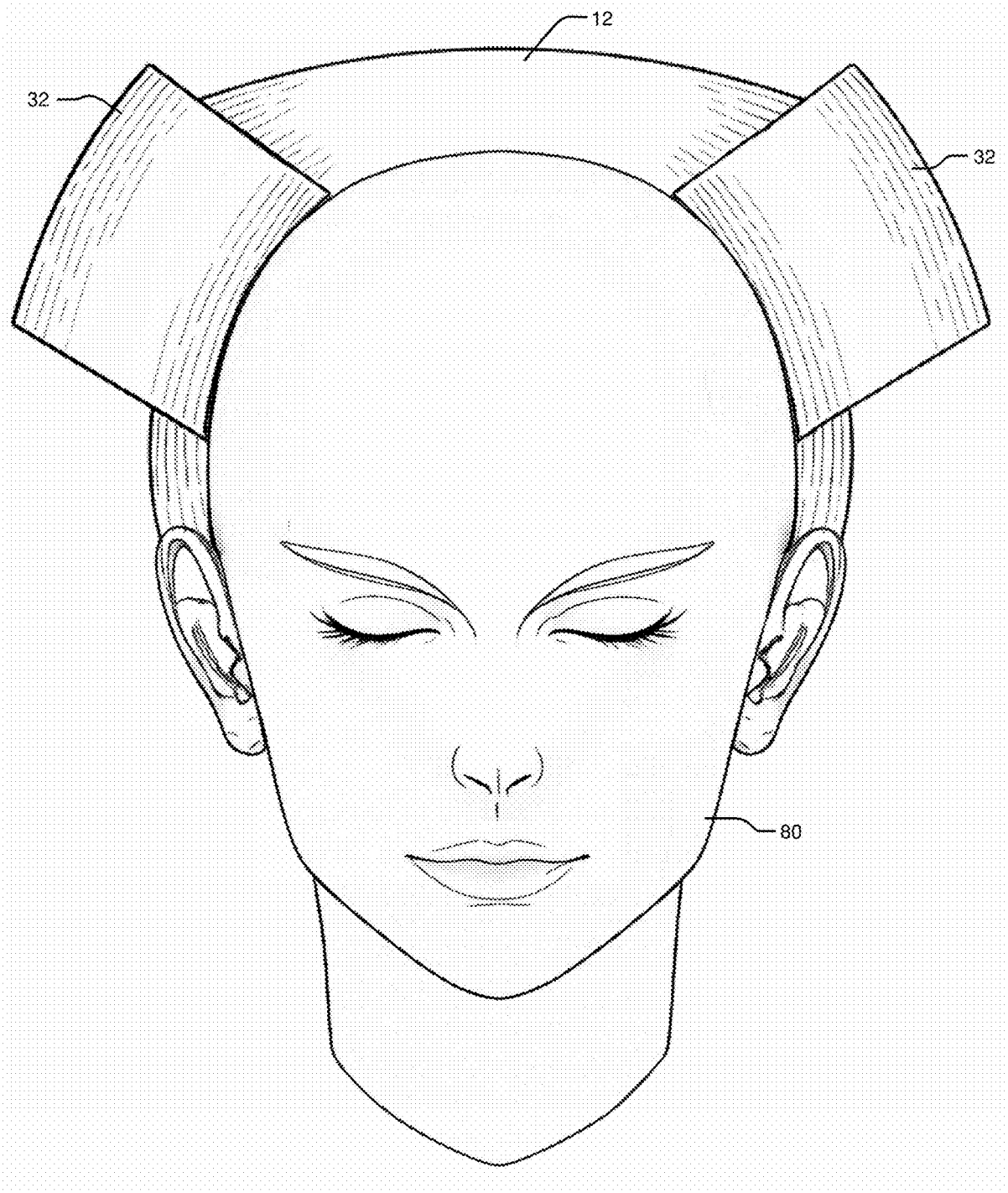
FIG. 2 is a top view of the embodiment of FIG. 1 with a person's head shown supported by the head support.

Illustrated in FIG. 2 is the embodiment of FIG. 1 of the head support 10 having a sleeper's head positioned in the base structure. The bumpers are deterring the sleeper from rolling over by providing a bumper on each side of the sleeper's head. If the sleeper unconsciously tries to roll to either side, contact of the sleeper's head against the bumpers deters the sleeper from rolling over. A secondary support 32 is attached to each bumper. Each of the depicted secondary supports includes internal hook and loop fasteners for attaching to the hook and loop fasteners 28 of bumpers. The secondary supports 32 increase the size of the bumpers. The secondary supports 30 can be attached based on user preference or, for example, to accommodate a user with a smaller head size or to provide a higher bumper to prevent a sleeper from rolling off. Additional supports can be provided so as to stack supports on top of the bumpers if desired.

Figure 3:
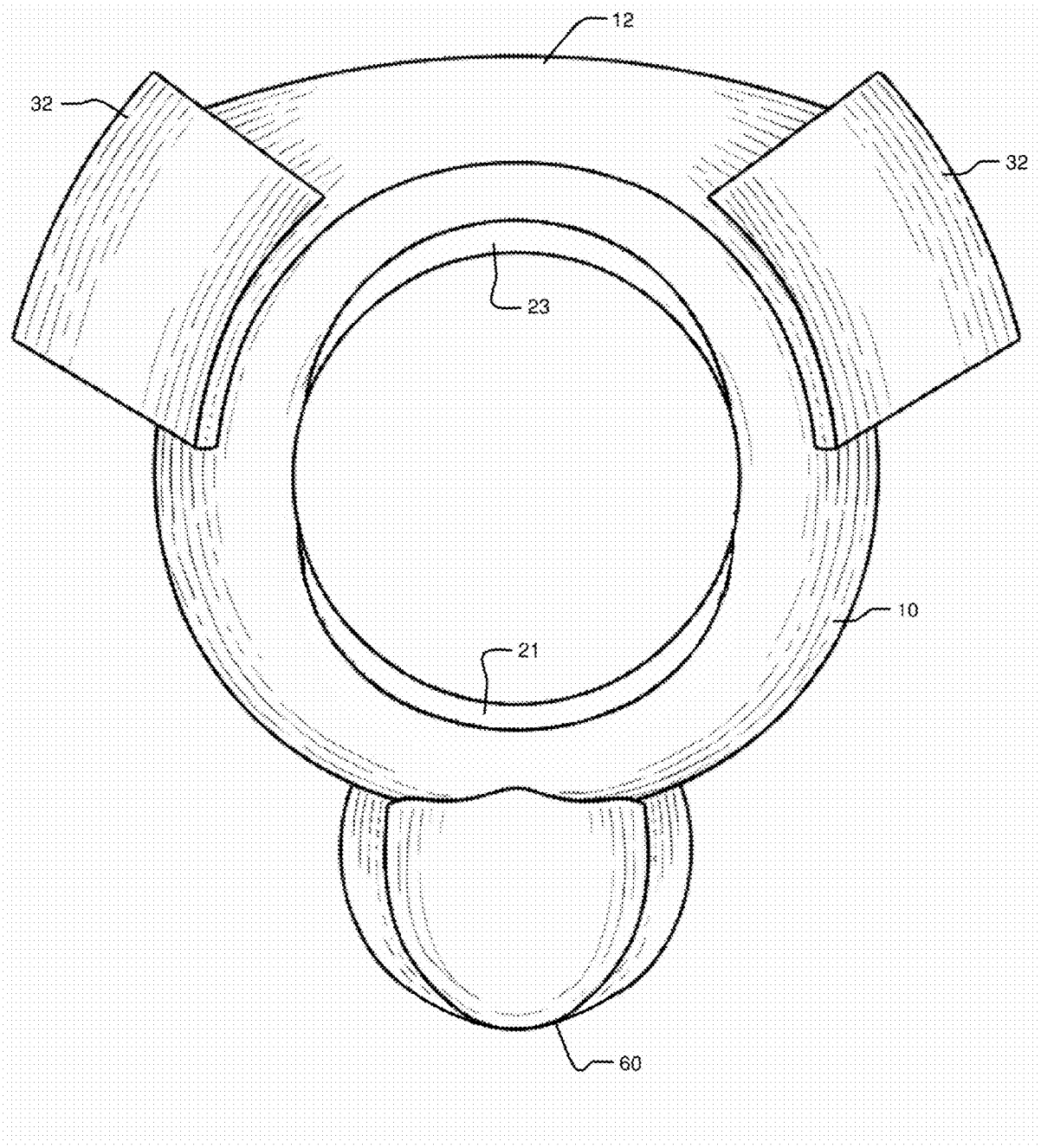
FIG. 3 is a top view of the embodiment of FIG. 1.

FIG. 3 illustrates a top view of the embodiment of FIGS. 1-2. The base support 12 is connected to the neck support 60. The internal circumference of the cavity has two scooped sections 21, 23. While these sections are shown at the back and the front of the base support, this contour can extend around the internal circumference or perimeter. The ring like base support is thicker at the back of the base support, as shown in further detail in FIG. 4, to provide additional support to the back of the device to provide a sturdier support.

The base support and secondary supports 32 are preferably made from nova foam. In alternate embodiments, the secondary supports and the base support can be made from compressible pillow filling material, such as down, feathers, polyethylene tubing, or other synthetic filler material, such as polyester fiber insulating material or a polyurethane material, that maintains its shape and resiliency without bunching or separating into clumps to provide firmness and uniformity to the head support.

Figure 4:
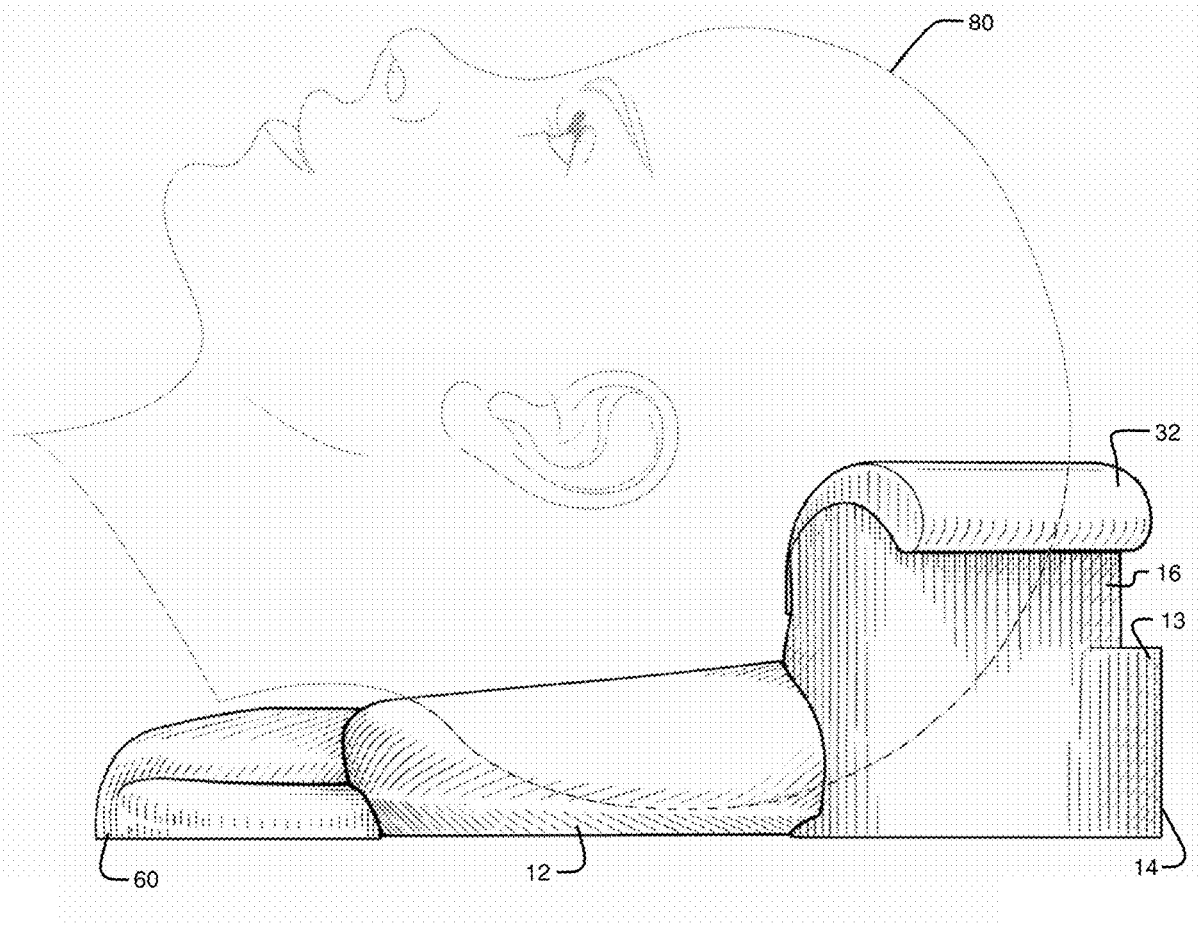
FIG. 4 is a side view of the embodiment of FIG. 1 with a head shown supported by the head support.
Figure 5:
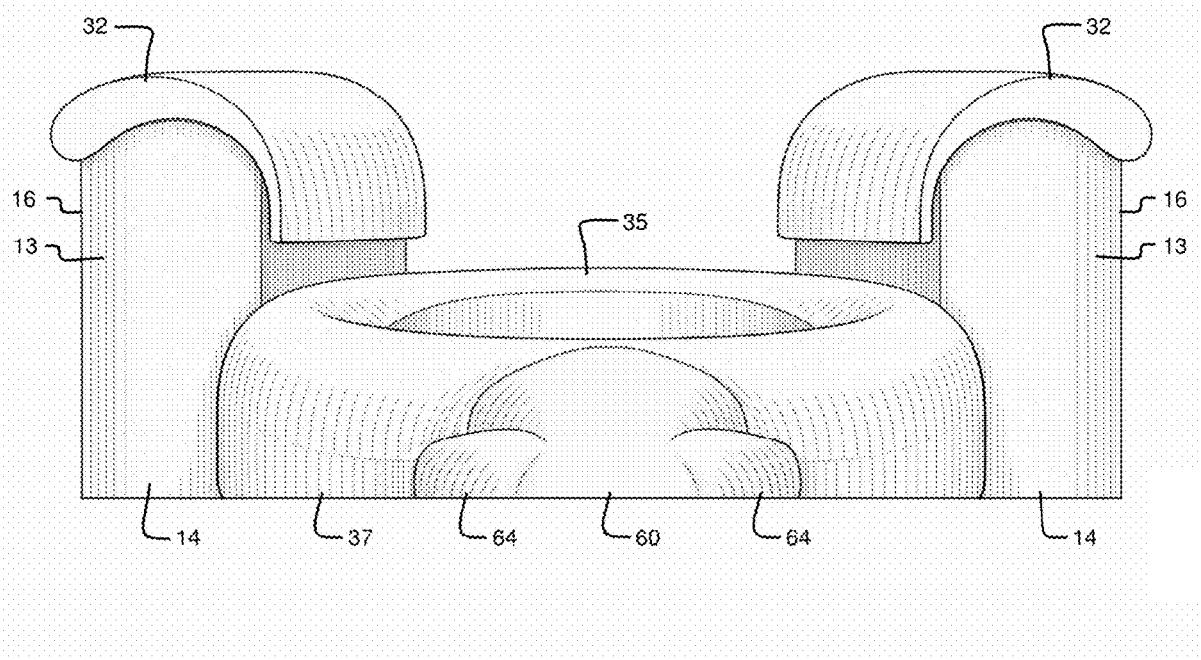
FIG. 5 is a front isometric view of the embodiment of FIG. 1.

FIG. 4 illustrates a side vie of the embodiment of FIGS. 1-3 with a sleeper's head positioned in the ring support. The secondary supports are attached to the bumpers 16. The stabilizing members are connected to the base support and extend away from the base support, providing support and stability to the base support.

A cover or pillow case can be positioned on the device, such as by attaching the cover to bumpers 16. The cover would preferably be removable to be washable, and can secured by a variety of mechanisms, such as by elastic bands or hook and loop fastener.

Figure 7:
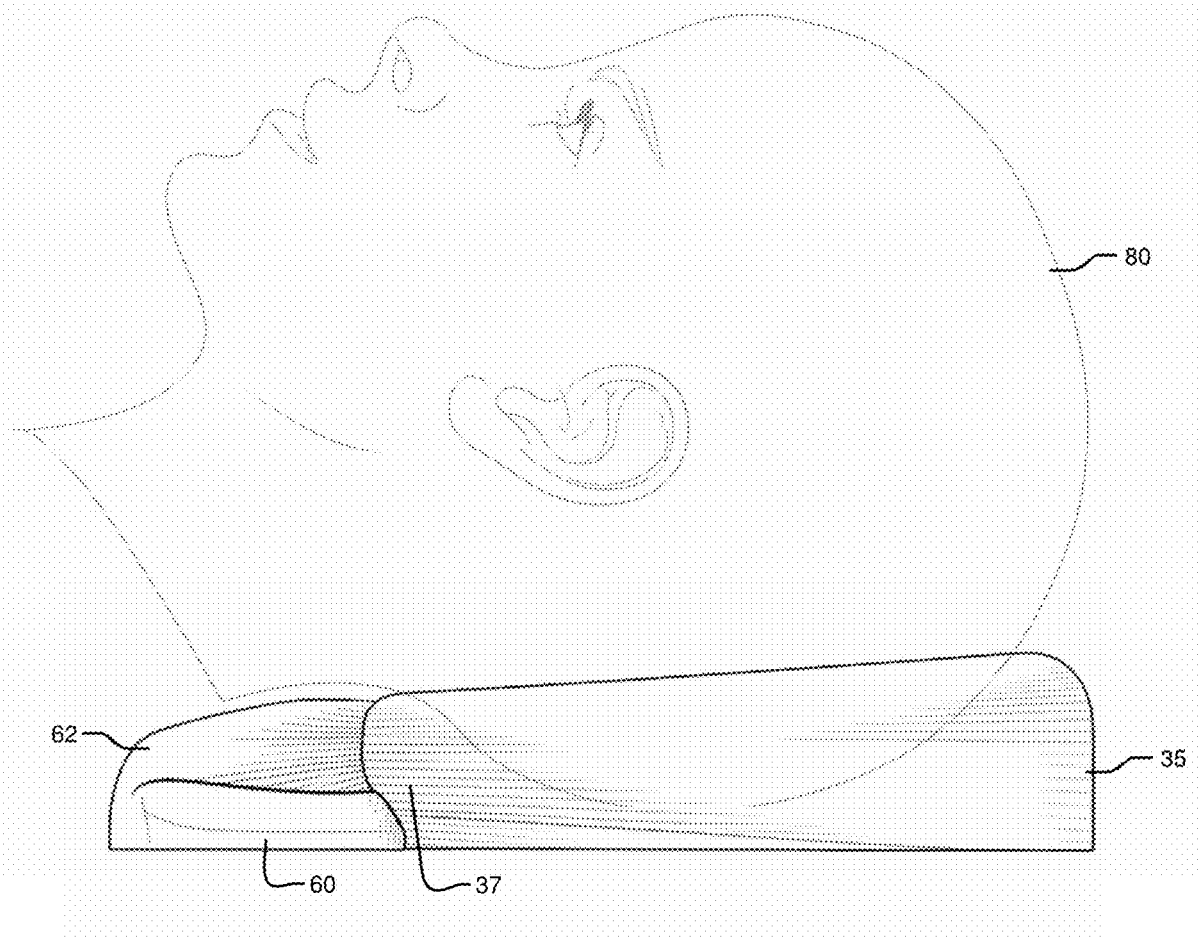
FIG. 7 is a side view of the illustration of FIG. 6 with a head shown supported by the head support to show the position of the back of the head in the base support.

FIGS. 6, 6.1 and 7 illustrate the embodiment of FIGS. 1-5 with stabilizing members and bumpers removed to illustrate the back of the user's head cradled in the ring. The user's head is cradled such that the back of the user's head does not touch the surface of the bed, as shown in FIG. 7. The device is sloped from the back of the base support 35 to the front of the base support 37. The slope continues to the optional neck support. The positioning of the back of the user's head into the base support, coupled with the bumpers discourages the sleeper from turning from the supine position to a lateral recumbent position (also called a side sleeping position).

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A head support configured for supporting the head of a person in a supine position, said support comprising:

a base support member, wherein said base support member defines a cavity configured for receiving at least a portion of the back of a user's head and to suspend the back of the person's head above a substrate on which the head support is positioned;

a first lateral stabilizer and a second lateral stabilizer, wherein said first lateral stabilizer and said second lateral stabilizer extend laterally from said base support member on generally opposing sides of said base support member, wherein said lateral stabilizer are configured to prevent a user from rotating the head support when the user's head is positioned in the head support in a supine position; and a least one bumper extending generally vertically from at least one of said lateral support or from said base support member, wherein said bumper is configured to prevent a person's head from rotating out of a supine position when the back of the user's head is positioned within said cavity.

2. The head support of claim 1, wherein said base support member comprises a substantially toroidal shape.

3. The head support of claim 1, wherein said at least one bumper comprises two bumpers positioned such that a first bumper prevents rotation of a user's head in a first direction and wherein a second bumper prevents rotation of a user's head in a second direction.

4. The head support of claim 1, wherein said bumper is configured for attaching a secondary support, wherein said secondary support is configured for reducing the lateral rotation of a user's head by increasing a width of the bumper.

5. The head support of claim 1, wherein said head support comprises a resilient material.

6. The head support of claim 1, wherein said head support is sloped from a back of said head support to a front of said head support.

7. The head support of claim 4, wherein said first lateral stabilizer and said second lateral are each connected to an outer circumference of said base support member.

8. The head support of claim 1, wherein said base support member comprises a ring support.

9. The head support of claim 4, wherein said secondary supports attach to said first and second lateral supports by hook and loop fasteners.

10. The head support of claim 1, wherein said head support comprises a neck support.

11. The head support of claim 10 wherein said neck support is removably attached to said base support member.

12. The head support of claim 11 wherein said neck support is removably attached to said base support member by hook and loop fastener.

13. The head support of claim 1, wherein an inner circumference of said base support member comprises a contour.

14. The head support of claim 13 where said contour is a scooped contour in said inner circumference of said base support member at a front of said head support and a back of said head support.

15. A head support configured for supporting the head of a person in a supine position, said support comprising:

a base support member, wherein said base support member defines a cavity configured for receiving at least a portion of the back of a user's head and to suspend the back of the person's head above a substrate on which the head support is positioned;

a first lateral stabilizer and a second lateral stabilizer, wherein said first lateral stabilizer and said second lateral stabilizer extend laterally from said base support member on generally opposing sides of said base support member, wherein said lateral stabilizer are configured to prevent a user from rotating the head support when the user's head is positioned in the head support in a supine position; and a least one bumper extending generally vertically from at least one of said lateral support or from said base support member, wherein said bumper is configured to prevent a person's head from rotating out of a supine position when the back of the user's head is positioned within said cavity.

16. The head support of claim 15 wherein said at least one lateral stabilizer comprises a first lateral stabilizer and a second lateral stabilizer, wherein said first lateral stabilizer and said second lateral stabilizer extend laterally from said base support member on generally opposing sides of said base support member, wherein said lateral stabilizer are configured to prevent a user from rotating the head support when the user's head is positioned in the head support in a supine position.

* * * * *